United States Patent [19]

Kitai

[11] 4,034,695

[45] July 12, 1977

[54] LUMBER WORK BOAT

[75] Inventor: Toshio Kitai, Nagoya, Japan

[73] Assignee: Kabushiki Kaisha Kitai Tekkosho, Nagoya, Japan

[21] Appl. No.: 699,963

[22] Filed: June 25, 1976

[30] Foreign Application Priority Data

Mar. 12, 1976 Japan ..... 51-26823

[51] Int. Cl.[2] ..... B63B 27/00

[52] U.S. Cl. ..... 114/268; 114/73; 214/12

[58] Field of Search ..... 114/268–270, 114/26, 27, 73, 40–42; 115/41 R; 214/1 R, 12, 15 R, 15 C, 15 D, 15 E

[56] References Cited

U.S. PATENT DOCUMENTS

| | | | |
|---|---|---|---|
| 2,731,741 | 1/1956 | Kaufmann | 114/26 |
| 2,885,990 | 5/1959 | Hawthorne | 115/41 R |
| 3,303,945 | 2/1967 | Hubbard et al. | 214/15 R |
| 3,556,319 | 1/1971 | Holden | 214/12 |
| 3,741,143 | 3/1973 | McKinley et al. | 114/268 |
| 3,971,309 | 7/1976 | Brodie | 214/12 |

*Primary Examiner*—Trygve M. Blix
*Assistant Examiner*—Stuart M. Goldstein

[57] ABSTRACT

A lumber work boat provided with an operating arm assembly at a bow portion of the boat for gathering up or moving lumber floating on the water. The boat has a recess to be opened frontwardly of the bow so that the operating arm assembly may be received within the recess, the assembly being driven by a drive mechanism disposed within the hull of the boat to transmit operating force to the operating arm assembly. The arrangement permits the entire work device to be positioned at a level lower than the upper deck, thereby providing a small type hull and enhancing mobility, while the operating arm assembly is protected since it is received in the recess when not in use, and the drive mechanism is not exposed to sea water or open air since it is encased within the hull.

11 Claims, 5 Drawing Figures

LUMBER WORK BOAT

BACKGROUND OF THE INVENTION

1. Field of the Invention

The present invention relates to lumber work boats provided with an operating arm assembly for handling lumber at a bow portion of the boat. More particularly, the invention relates to a lumber work boat, in which at the bow portion there is formed a frontwardly open recess, within which the afore-mentioned operating arm assembly may be received, said operating arm assembly being driven by a drive mechanism disposed interiorly of the hull.

2. Description of the Prior Art

It is difficult to gather up or re-arrange lumber floating on the surface of the water, or to move the lumber from one position to another in a floating condition, and hence, lumber work boats are conventionally used to efficiently carry out such lumber handling operations. The lumber work boat is provided with a lumber handling device for handling lumber floating on the surface of the water, and this device may be power operated. The lumber work boat can handle the lumber efficiently, but in order to accomplish the work in more efficient and safe manner, the lumber work boat must be of the type which can turn in a small circle to allow the boat to freely and actively move in narrow waterways or between lumber, and which has high stability so that the boat may operate under stable conditions.

In the known lumber work boats, the lumber handling device is usually disposed on the upper deck of the hull of the boat. Since the lumber work boat is constructed to be as small as possible to enhance its mobility, with a heavy work device disposed on the upper deck, the center of gravity of the entire boat is raised which decreases the stability of the boat.

Usually, the work devices such as the lumber handling device are disposed at the bow portion. For this reason, the weight of the bow portion is increased to move the center of gravity of the entire boat forwardly, resulting in reduction of sea worthiness of the hull adversely affecting navigation, and difficulty in carrying out stabilized operation.

If the work device is disposed on the upper deck, the height of the work device above the water surface is great, and therefore, for example, in the case where lumber on the water surface is gathered up at the broadside of a large boat, when the lumber work boat tries to come near the stern of the large boat, the work device comes into contact with the stern portion of the large boat, as a consequence of which the lumber flowing into the narrow portion of the stern portion of the large boat cannot be gathered up and in addition, the stern portion of the large boat may be damaged.

Since a load is exerted upon the tip portion of the work device during operation, the construction of the boat where the work device is mounted must be made rigid when the latter is disposed on the upper deck. However, if the mounting portion for the work device employs a rigid construction, such portion will increase in weight because of the provision of such construction, whereby it is difficult to maintain the weight balance of the hull of the boat.

Furthermore, drive devices such as hydraulic cylinders adapted to drive the work device and precision machining members, such as bearings, used in support portions of the work device are disposed on the deck, whereby these devices and members easily rust and materially impair the durability of these devices and members. As a result, the hydraulic system is susceptible to damage and oil leaked through the damaged portions flows out onto the surface of the water to contaminate the water.

SUMMARY OF THE INVENTION

It is a primary object of the present invention to provide a lumber work boat in which the work device is disposed at a position below the upper deck.

It is a further object of the invention to provide a lumber work boat in which the work device is received in a recess formed in the hull when not in use thereby to overcome inconveniences at the time of navigation.

It is another object of the invention to provide a lumber work boat in which a drive means for driving the work device is disposed interiorly of the hull of the boat, and the driving force from the drive means is transmitted as an operating force to the work device by a transmitting means which extends water-tightly between the interior and the exterior of the hull.

According to the present invention, a frontwardly open recess is formed at a bow portion of the hull of the lumber work boat. This recess may be formed by integrally mounting a recess forming frame body, which comprises a pair of right and left side plates and a back plate, on the hull of the boat. The work device includes an operating arm assembly for handling lumber, the assembly being rotatable about a horizontal axis of rotation disposed in the recess so that the assembly may be rotated frontwardly from the interior of the recess into an operative position whereas it may be received into the recess when out of operation. An operating arm which forms part of the operating arm assembly may be of hollow construction, whereby the work device may be light-weight, and when the work device is submerged under the surface of the water, a great buoyancy is exerted thereupon to enhance the sea worthiness of the lumber work boat to assure stable navigation. The base end of the operating arm assembly may be of simply mountable construction so that the operating arm assembly may suitably be removed as a unit assembly from the interior of the recess. Thereby, replacement of the operating arm assembly may readily be achieved, and in addition, during navigation the operating arm assembly may also be removed in entirety.

Furthermore, according to the present invention, the drive device for driving the operating arm assembly is disposed interiorly of the hull, and the transmitting means extends through the side plates of the recess forming frame body in water-tight condition to transmit the driving force of the drive device within the hull to the operating arm assembly. Thus, the drive device is prevented from being exposed to sea water and open air which may otherwise significantly impair its durability due to the formation of rust and corrosion. In addition, even if oil in the hydraulic system should leak, the oil would not run out onto the water surface since it is sealed in the hull of the boat.

The hull may be provided with a propeller in a position frontwardly of the bottom of the boat, which can direct thrust in all directions, thereby to increase the mobility of the lumber work boat. Furthermore, the propeller may be surrounded by a protection screen so as to be protected from driftwood or other obstacles on the surface or in the water.

Further objects and features of this invention will become apparent from the following description and from the accompanying drawings.

DESCRIPTION OF THE PREFERRED EMBODIMENTS

Figure 1:
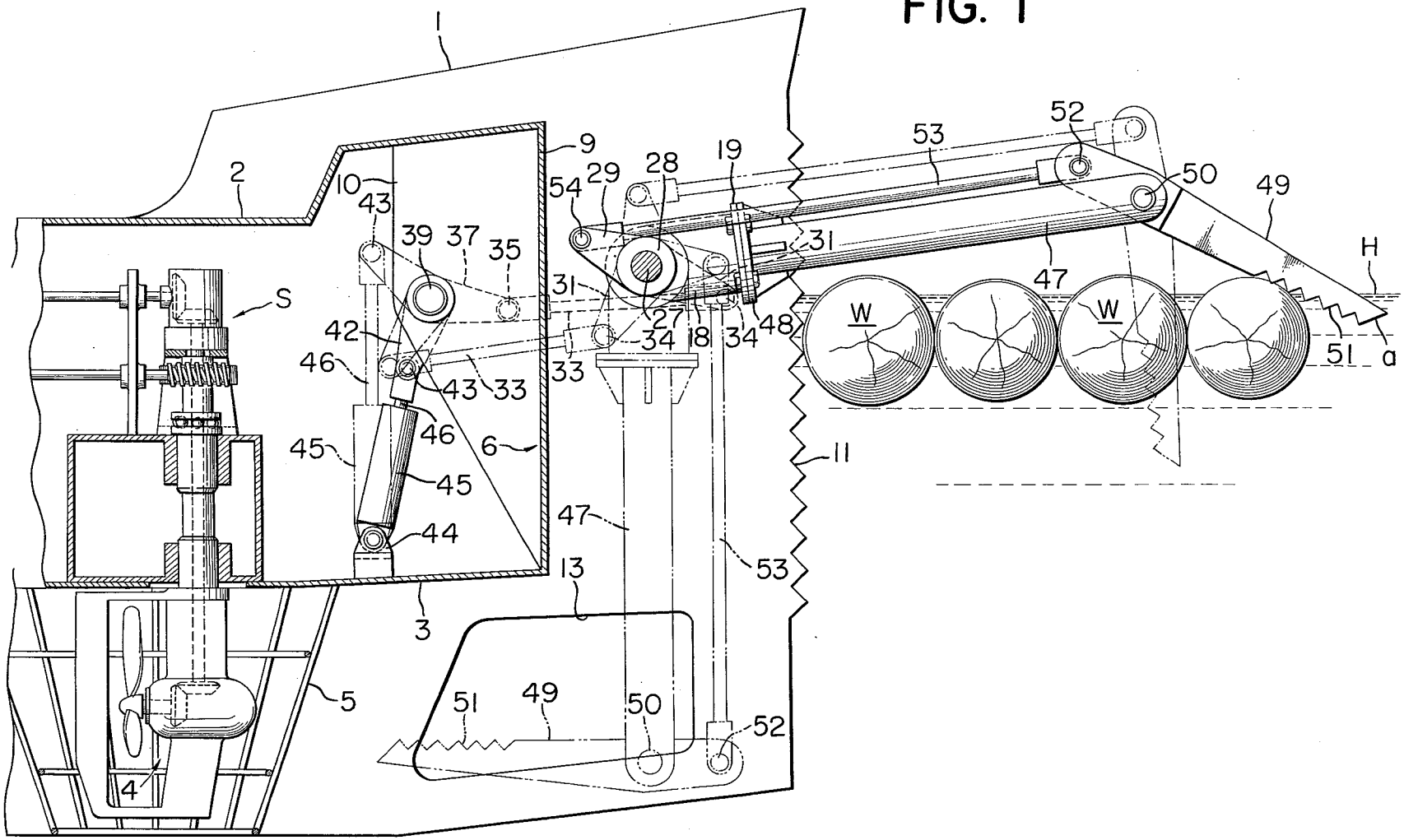
FIG. 1 is a sectional side elevational view showing an essential portion of a lumber work boat according to the present invention.
Figure 2:
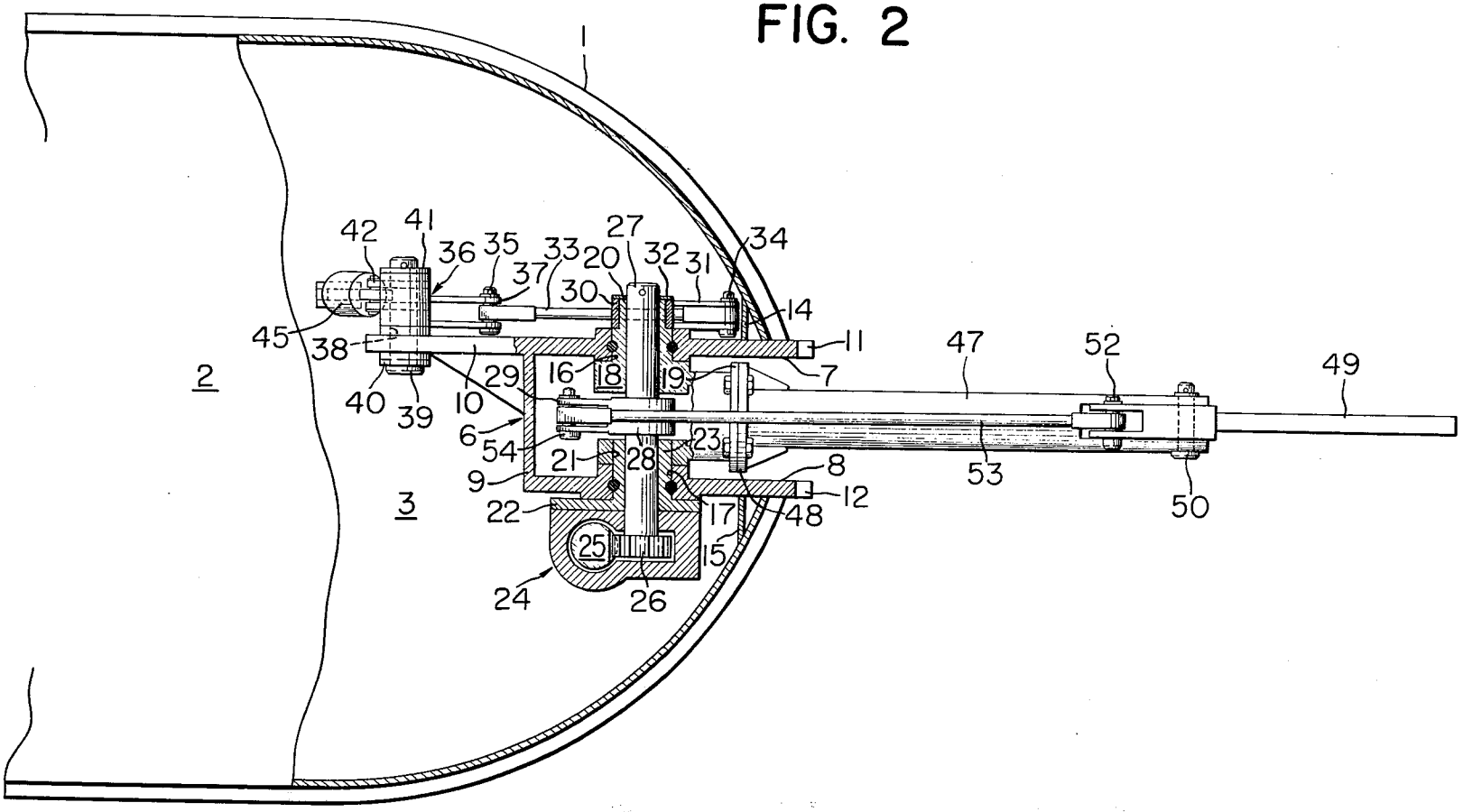
FIG. 2 is a sectional top plan view showing an essential portion of the lumber work boat of FIG. 1.

Turning now to FIGS. 1 and 2, the hull 1 comprises a deck 2 and a bottom wall 3, and disposed in a position downwardly and frontwardly of the bottom wall 3 is a propeller 4 which can turn to apply thrust in all direction. The propeller 4 has its circumference surrounded by a protection screen 5, and a steering arrangement S is provided interiorly of the hull 1 to turn the propeller in a suitable direction.

The hull 1 has a bow portion provided with a recess forming frame body 6 so as to form a frontwardly open recess in the hull 1. This recess forming frame body 6 comprises a side plate 7 fixedly mounted together with a reinforcing member 14 on a left-hand broadside plate of the hull 1, a side plate 8 fixedly mounted together with a reinforcing member 15 on a right-hand broadside plate of the hull 1, a back plate 9 connected to the deck 2 and bottom wall 3, and a rearwardly projecting projection 10. The side plates 7 and 8 have front edges projecting frontwardly beyond the right and left broadside plates, respectively, of the hull 1, the front edges having front end surfaces formed with saw-tooth work surfaces 11 and 12, respectively. Downwardly of the side plates 7 and 8 is formed an opening 13 to alleviate fluid resistance as the hull 1 moves sidewise.

The side plates 7 and 8 are formed therein with flanged supporting holes 16 and 17, respectively, the supporting hole 16 in the side plate 7 pivotally supporting a hollow pivot arm 20 of a base rotary body 18 having a mounting flange 19, and the supporting hole 17 in the side plate 8 pivotally supporting a hollow shaft 23 of a supporting plate 22, which is firmly received in a hole 21 made in the base rotary body 18 and is rotated integrally with the base rotary body 18. Seal members are interposed between the hollow pivot arm 21 and the supporting hole 16 and between the hollow shaft 23 and the supporting hole 17, whereby the hollow pivot arm 20 and the hollow shaft 23 may be rotated as a rotating shaft of the base rotary body 18 in a water-tight condition in integral relationship with the side plates 7 and 8 and hence, the hull 1.

The supporting plate 22 has a drive device 24 integrally secured thereto, and a pinion gear 26 in engagement with a rack 25 hydraulically reciprocable within the drive device 24 is secured to one end of a rotating shaft 27 which extends in the hollow pivot arm 20 and the hollow shaft 23 for free relative rotation. At the middle of the rotating shaft 27 there is fixed an operating wheel 28, which is provided with a projecting arm 29, integral with the rotating shaft 27. Thus, the base rotary body 18 forms a first rotary body which rotates relative to the hull 1, whereas the rotating shaft 27 forms a second rotary body which is driven by the drive device 24 rotating integrally with the first rotary body and rotatable relative to the first rotary body.

Key-fitted on the end of the hollow pivot arm 20 projecting from the side plate 7 towards the inside of the hull 1 is a rotating wheel 30 having a rotatable arm 31, which is prevented from being disengaged by a washer 32 secured to the end of the rotating shaft 27. A pivot pin 39 fitted in a flanged hole 38 in the tip portion of the projection 10 of the recess forming frame body 6 has a hollow rotating shaft 36 with crank arms 37 and 42 rotatably fitted therein, the hollow rotating shaft 36 being retained by washers 40 and 41 secured to the opposite ends of the pivot pin 39. A connecting rod 33 has one end pivotally connected by means of a pivot pin 35 to the tip portion of the crank arm 37 and the other end pivotally connected to the tip portion of the rotatable arm 31 of the rotating wheel 30 by means of a pivot pin 34. The tip portion of the crank arm 42 is pivotally connected, by means of a pivot pin 43, to the free end of a rod 46 of a hydraulic cylinder 45 supported on a bracket 44 secured to the bottom wall 3 of the hull 1.

Thus, the hydraulic cylinder 45 forms a first drive device which serves to rotate the base rotary body 18, which is a first rotary body, with respect to the hull 1 through the crank arms 42, 37, the connecting rod 33, and the rotatable arm 31, whereas the drive device 24 forms a second drive device which serves to rotate the rotating shaft 27, which is a second rotary body, relative to the base rotary body 18.

A base end of a hollow operating arm 47 is removably mounted by means of a plurality of fixing bolts on the base rotary body 18 by utilization of the mounting flange 19 of the base rotary body 18 and a mounting flange 48 of the operating arm 47. A portion near the base end of a work pawl 49 having an acute tip portion *a* and a saw-tooth work surface 51 adjacent thereto on the side of the tip portion is pivotally connected to the tip portion of the operating arm 47 by means of a pivot pin 50. An operating rod 53 has a tip portion pivotally connected by means of a pivot pin 52 to the base end of the work pawl 49 and rod 53 extends towards the base of the operating arm 47 along the arm 47 and is removably connected at the base end thereof to the tip portion of the projected arm 29 by means of a pivot pin 54.

Figure 3:
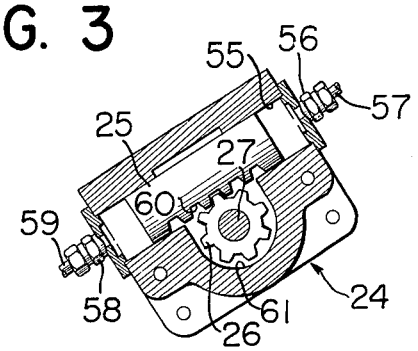
FIG. 3 is a sectional view showing an essential portion of a drive device.
Figure 5:
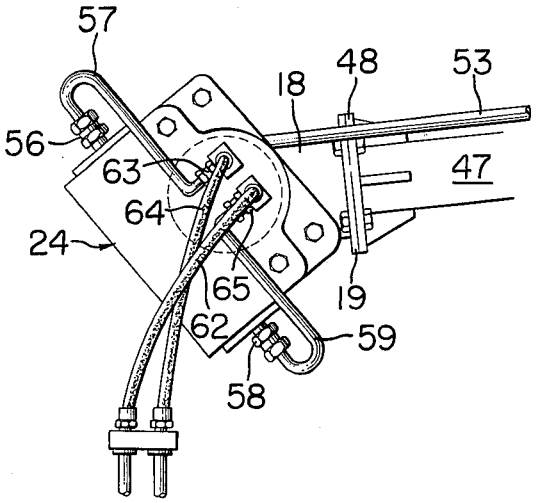
FIG. 5 is another side elevational view showing an essential portion of the drive device of FIG. 3 in a rotated condition different from that shown in FIG. 4.
Figure 4:
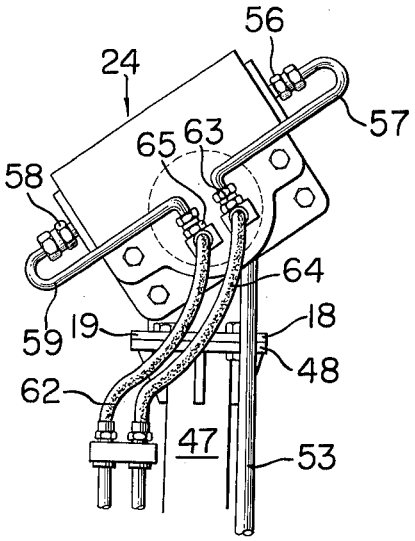
FIG. 4 is a side elevational view showing an essential portion of the drive device of FIG. 3.

Details of the drive device 24 are shown in FIGS. 3, 4, and 5. Referring first to FIG. 3, the drive device 24 is internally formed with a cylindrical internal hole 55 having opposite ends thereof provided with ports 56 and 58, respectively, the cylindrical internal hole 55 axially slidably receiving therein rack 25 having a tooth-face 60 in engagement with pinion gear 26 rotated within a recess 61. Referring to FIGS. 4 and 5, an oil feed pipe 57 in communication with the port 56 is connected to an oil feed pipe 62 through a connecting element 63, whereas an oil feed pipe 59 in communication with the port 58 is connected to an oil feed pipe 64 through a connecting element 65. The oil feed pipes 62 and 64 are in communication with an oil pressure source (not shown), and pressure oil is introduced into the port 56 or port 58 by an oil pressure change-over device (not shown) to axially move the rack gear 25 accordingly, thereby rotating and driving the pinion gear 26. It is noted that the oil feed pipes 57, 59, 62 and 64 are each free to undergo relative motion and may cooperate with the connecting elements 63 and 65 to enable permitting the relative rotational motion of the drive device 24 with respect to the hull 1.

From the foregoing arrangement, it will be appreciated that when the hydraulic cylinder 45, i.e. the first drive device, is retracted in a state where the hollow operating arm 47 is received within the recess formed by the recess forming frame body 6 as indicated by the chain-dotted lines in FIG. 1, the base rotary body 18, i.e. the first rotary body, is rotated, and at the same time, the operating arm 47 is frontwardly rotated as shown by the solid lines in FIG. 1. At this time, the drive device 24, i.e. the second drive device, is integrally rotated along with the base rotary body 18 and the operating arm 47. The drive device 24 is driven and operated independently of the hydraulic cylinder 45. Then, when the drive device 24 is driven, the rotating shaft 27, i.e. the second rotary body, rotates relative to the base rotary body 18 with the result that the projecting arm 29 rotates so that the work pawl 49 responsive to the projecting arm 29 through the operating rod 53 rotates relative to the operating arm 47.

Thus, the hydraulic cylinder 45 and the drive device 24 are driven in cooperation with each other, whereby lumber W afloat on the water surface H may be moved while being held between the saw-tooth work surfaces 11 and 51, or the work pawl 49 may be operated to gather up scattered lumber, or the acute tip portion *a* of the work pawl 49 may be utilized to orderly arrange the lumber on the water surface.

The operating arm 47, the work pawl 49 and the operating rod 53 constitute an operating arm assembly. When the operating arm assembly is desired to be received in the recess in the bow portion after the operation has been completed, the assembly may be received in place in a state as indicated by the chain-dotted lines in FIG. 1, by expanding the the hydraulic cylinder 45 and at the same time by driving the drive device 24.

The operating arm 47, which is of hollow construction, is useful in making the operating arm assembly a light weight structure, and when the operating arm is submerged, the action of buoyancy exerted upon the submerged portion may effectively be utilized to stabilize the bow portion and to enhance sea worthiness.

Since the operating arm 47 is removably mounted on the base rotary body 18 and the operating rod 53 is pivotally and removably supported with respect to the projecting arm 29, the operating arm assembly and the members which constitute the same can be replaced in easy manner. In the case of long-distance navigation and where the operating arm assembly is not used for a long period of time, the operating arm assembly may be removed in order to alleviate the weight at the bow portion so as to assure safe navigation, and protect the operating arm assembly.

As is obvious from the foregoing description, it will be understood from the present invention that because of the provision of the frontwardly open recess at the bow portion for support of the operating arm assembly within the recess, the entire work device may be disposed at a low position with respect to the hull, whereby the hull may be of a small type, without impairing the stability, to reduce the turning circle and the mobility and to provide balance for the accomplishment of safe operations. Moreover, since the operating arm assembly may be received within the recess, the operating arm assembly can be protected, and the buoyancy, which is exerted upon the portion where the operating arm assembly is submerged, may be utilized to alleviate the weight carried by the bow portion.

Further, according to the present invention, since the drive device is disposed interiorly of the hull, and the operating force transmitting means extends between the interior of the hull and the recess in water-tight condition to transmit the driving force of the drive device for the operation of the operating arm assembly, the drive device is prevented from being exposed to sea water and open air and is prevented from becoming significantly impaired in durability due to the presence of rust and corrosion, and even if oil, such as, working oil or lubricating oil should leak from the hydraulic system, the oil would not run out onto the water surface to cause contamination of the surface of the water since the oil is sealed in the hull.

What is claimed is:

1. A lumber work boat comprising a hull including a bow portion with a forwardly open recess therein;

an operating arm assembly for handling lumber, a horizontal rotatable shaft extending through said recess and mounted in said hull supporting said assembly for movement between an inoperative position in which said assembly is received in said recess and an operative position in which said assembly projects forwardly from said recess;

drive means disposed interiorly in said hull for driving said operating arm assembly; and operating force transmitting means operatively connecting said drive means with said operating arm assembly and extending through said hull into said recess for transmitting driving force from said drive means to said operating arm assembly as an operating force for the lumber handling operation and for displacing said arm assembly between said operative and inoperative positions.

2. A lumber work boat as claimed in claim 1 wherein said operating arm assembly has a base end of simply mountable construction including means for separating said assembly as a unit assembly from said shaft.

3. A lumber work boat as claimed in claim 1 wherein said operating arm assembly includes an operating arm of hollow construction.

4. A lumber work boat as claimed in claim 1 comprising a propeller disposed at the front portion of the bottom of said hull, said propeller being turnable to direct thrust in all directions.

5. A lumber work boat as claimed in claim 1 comprising a protection screen surrounding said propeller.

6. A lumber work boat as claimed in claim 1 wherein said recess is defined by a recess-forming frame body comprising a pair of right and left side plates and a back plate.

7. A lumber work boat as claimed in claim 6 wherein each of said right and left side plates has a front edge projecting frontwardly from said hull, said front edge being provided with a saw-tooth work surface.

8. A lumber work boat as claimed in claim 1 wherein said drive means comprises first and second drive devices disposed interiorly of said hull, said operating force transmitting means comprising a first rotary body coupled to said first drive device for being rotated relative to said hull by said first drive device and a second rotary body coupled to said second drive device for being rotated relative to said first rotary body by said second drive device.

9. A lumber work boat as claimed in claim 8 wherein said operating arm assembly comprises a hollow operating arm having a base end removably secured to said first rotary body; a work pawl member having an acute tip end and a saw-tooth work surface adjacent thereto, said work pawl member being pivotally supported at the free end of said operating arm, and an operating rod extending along said operating arm for operating said pawl member to pivot the same about the pivotal connection thereof with said operating arm, said operating rod being pivotally connected at one end to said work pawl member at a point remote from the pivotal connection thereof with said operating arm and at a location spaced from said acute tip end of said work pawl member and at the other end to said second rotary body for rotation therewith.

10. A lumber work boat as defined in claim 8 wherein said first drive device comprises a hydraulic cylinder having one end pivotally supported on said hull, said hydraulic cylinder having an opposite end, a link mechanism connecting said opposite end of the hydraulic cylinder to said first rotary body for converting reciprocating motion of said hydraulic cylinder into rotary motion of said first rotary body, said second drive device comprising a hydraulically-driven device fixedly supported on said first rotary body and including a rack adapted to be reciprocated under fluid pressure and a pinion gear in mesh with said rack and secured to said second rotary body for rotation therewith.

11. A lumber work boat as defined in claim 1 wherein said drive means comprises a hydraulically-driven device.

* * * * *